US010327055B2

(12) United States Patent
Peeters

(10) Patent No.: US 10,327,055 B2
(45) Date of Patent: Jun. 18, 2019

(54) CLOSED ACOUSTICAL ARCHITECTURE HAVING A CONTROLLED LEAKAGE

(71) Applicant: Tymphany HK Limited, Wanchai (HK)

(72) Inventor: Thomas Pieter J. Peeters, Taipei (TW)

(73) Assignee: TYMPHANY HK LIMITED, Wan Chai, Hong Kong (CN)

( * ) Notice: Subject to any disclaimer, the term of this patent is extended or adjusted under 35 U.S.C. 154(b) by 0 days.

(21) Appl. No.: 15/652,014

(22) Filed: Jul. 17, 2017

(65) Prior Publication Data

US 2018/0027317 A1 Jan. 25, 2018

Related U.S. Application Data

(60) Provisional application No. 62/364,121, filed on Jul. 19, 2016.

(51) Int. Cl.

| | |
|---|---|
| ***H04R 1/10*** | (2006.01) |
| ***H04R 1/28*** | (2006.01) |
| *H04R 5/033* | (2006.01) |

(52) U.S. Cl.

CPC ..... *H04R 1/1008* (2013.01); *H04R 1/1058* (2013.01); *H04R 1/1075* (2013.01); *H04R 1/2811* (2013.01); *H04R 5/033* (2013.01); *H04R 2460/11* (2013.01); *H04R 2499/11* (2013.01)

(58) Field of Classification Search

CPC .. H04R 1/1008; H04R 1/1075; H04R 1/2811; H04R 1/2888; H04R 25/48; H04R 5/033; H04R 2201/107; H04R 2460/11; H04R 2499/11; H04M 1/035

USPC ..... 381/345, 347, 350, 351, 353, 354, 370, 381/371, 373, 376, 380, 382; 379/430, 379/433.02, 432; 181/129, 130

See application file for complete search history.

(56) References Cited

U.S. PATENT DOCUMENTS

| | | | | | |
|---|---|---|---|---|---|
| 2,363,175 | A * | 11/1944 | Grossman | H04R 25/48 | 181/132 |
| 3,798,393 | A * | 3/1974 | Gorike | H04R 1/1008 | 381/347 |
| 5,790,679 | A * | 8/1998 | Hawker | H04M 1/0202 | 379/388.02 |
| 5,844,998 | A * | 12/1998 | Nageno | H04R 1/2842 | 381/371 |
| 7,391,878 | B2 * | 6/2008 | Liao | H04R 5/033 | 381/370 |

* cited by examiner

*Primary Examiner* — Huyen D Le
(74) *Attorney, Agent, or Firm* — Cantor Colburn LLP

(57) ABSTRACT

An acoustical device includes a housing operative to be placed proximate to an ear of a wearer and a front volume partially defined by the housing. A controlled leakage path is disposed to acoustically and selectively couple the front volume of the housing with an exterior of the device.

20 Claims, 1 Drawing Sheet

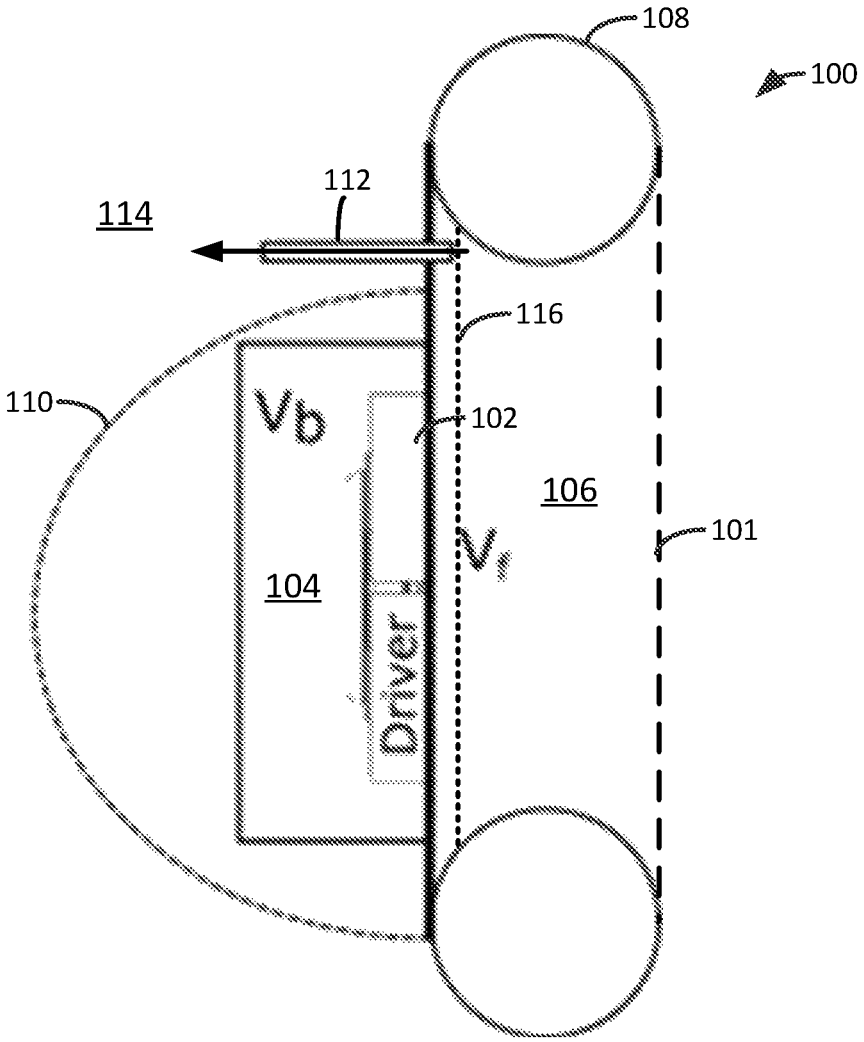
FIGURE

CLOSED ACOUSTICAL ARCHITECTURE HAVING A CONTROLLED LEAKAGE

TECHNICAL FIELD

The present disclosure relates to audio applications, and more specifically, to acoustical devices such as headphones.

BACKGROUND

Fully closed headphones (circum-aural or supra-aural) are generally not seen in the current market. By fully closed it is meant that there are no venting or controlled acoustic leakages from the front volume to the outside, from the back volume to the outside or connecting the front and back volumes.

There are various reasons why a fully closed headphone acoustical architecture may not be the preferred acoustical system.

(1) The fully closed front volume will cause a DC pressure on the headphone driver, potentially causing permanent deformation of the diaphragm (2) The fully closed acoustical system will be very susceptible to uncontrollable leakages occurring when the headphones are in use. A leakage may be introduced between the ear pad and the wearer's head and/or ear due to hair or glasses.

SUMMARY

According to an embodiment an acoustical device includes a housing operative to be placed proximate to an ear of a wearer and a front volume partially defined by the housing. A controlled leakage path is disposed to acoustically and selectively couple the front volume of the housing with an exterior of the device.

According to another embodiment an acoustical device includes a housing, a back volume arranged in the housing, a driver arranged in the back volume, and a front volume arranged in the housing. A controlled leakage path, arranged such that the front volume is communicative with an exterior of the device via the controlled leakage path.

BRIEF DESCRIPTION OF THE DRAWING

For a more complete understanding of this disclosure, reference is now made to the following brief description, taken in connection with the accompanying drawings and detailed description, wherein like reference numerals represent like parts:

The single FIGURE shows a cut-away view of a headphone device.

DETAILED DESCRIPTION

As discussed above there are several disadvantages to fully closed headphones. However, there are also several advantages for preferring a fully closed headphone acoustical architecture.

(1) By fully closing the back volume, the back volume can be minimized in size as no account need to be taken of the mechanical and acoustical dimensions of venting. This minimized back volume allows for more freedom in the industrial design;

(2) The ear cup housing may have uncontrolled leakages (e.g. due to mechanical buttons to operate the headphones, hinges that couple the earcup to the headband structure, etc.). By fully closing the back volume behind the driver, these uncontrolled leakages will not influence the headphones audible frequency response.

What is desired is a closed acoustical device having a controlled leakage that benefits from the advantages of a fully closed systems but that does not include the disadvantages.

Referring to the FIGURE, a cut-away view of a headphone 100 is shown as including a driver 102. The driver 102 is a transducer for converting an electrical signal into audible sound. The driver is communicatively connected to an audio source (not shown) to receive the electrical signals.

A back volume $V_b$ 104 is a fully closed (sealed) volume (cavity) behind the driver 102. A front volume $V_f$ 106 is a volume (cavity) in front of the driver 102. The front volume 106 couples the driver 102 acoustically to a wearer's ear when worn. An ear pad (cushion) 108 may be a circum or circa aural ear pad, for creating an acoustical seal with the wearers head and/or ear, which are represented by the line 101.

An ear cup housing 110 is the external portion of the ear cup, which encloses, among other elements, the headphone driver 102, the back volume 104, and in some embodiments electronics for audio processing and/or wireless communication in embodiments with wirelessly connected headphones.

The acoustical device of the FIGURE introduces a controlled leakage path 112 into a fully closed acoustical architecture, which couples the front volume 106 to the outside ambient air 114. The back volume 104 remains fully closed such that the only controlled leakage path 112 is from the front volume 106 to the outside.

This controlled leakage path 112 makes the closed headphones less susceptible to uncontrolled leakages occurring between the ear pad 108 and the wearers head and/or ear.

The controlled leakage path 112 lowers the risk of damaging the driver 102 diaphragm when the headphones 100 are in use.

This controlled leakage path 112 is dimensioned as such that the audible sound is affected in the very low frequencies. This can for example be achieved by dimensioning the controlled leakage path 112 as a long but narrow, hollow tube where the length of the tube is greater than the width of the tube. The hollow tube has a large acoustical mass.

The mechanical element introducing the controlled leakage path 112 may in some embodiments also include an additional resistive acoustical member 116, in the form of for example a mesh or woven material. This resistive acoustical member 116 may introduce further control over the acoustical behavior of the front volume and the controlled leakage path 112.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While the preferred embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. An acoustical device, comprising:

a housing operative to be placed proximate to an ear of a wearer;

a front volume partially defined by the housing; and a controlled leakage path disposed to acoustically and selectively couple the front volume of the housing with an exterior of the device;

wherein the acoustical device when worn comprises a fully closed acoustical architecture such that the front volume is fluidly isolated from the exterior of the device except for the controlled leakage path;

wherein the controlled leakage path comprises an elongated tubular element extending from the housing; and wherein a length of the tubular element is longer than a width thereof.

2. The device of claim 1, wherein the controlled leakage path is partially defined by a hollow tube.

3. The device of claim 2, wherein the hollow tube has a length greater than a width of the hollow tube.

4. The device of claim 1, wherein the front volume is partially defined by a driver, an ear pad, and the ear of a wearer.

5. The device of claim 1 further comprising:

a back volume arranged in the housing; and a driver arranged in the back volume.

6. The device of claim 5, wherein the back volume is sealed.

7. The device of claim 5, wherein the driver is operative to convert an electrical signal into an audible sound.

8. The device of claim 1 further comprising a resistive acoustical member arranged in the front volume.

9. The device of claim 8, wherein the resistive acoustical member includes a woven material.

10. The device of claim 8, wherein the resistive acoustical member includes a mesh.

11. The device of claim 1 further comprising an ear pad arranged proximate to the front volume of the housing.

12. The device of claim 1, wherein the controlled leakage path defines a communicative path between the front volume and the ambient exterior of the device.

13. An acoustical device, comprising:

a housing;

a back volume arranged in the housing;

a driver arranged in the back volume;

a front volume arranged in the housing; and a controlled leakage path, wherein the front volume is communicative with an exterior of the device via the controlled leakage path;

wherein the back volume is closed so as to be fluidly isolated from the front volume and from the exterior of the device;

wherein the front volume is closed when the acoustical device is worn so as to be fluidly isolated from the back volume and from the exterior of the device except for the controlled leakage path;

wherein the controlled leakage path comprises an elongated tubular element extending from the housing; and wherein a length of the tubular element is longer than a width thereof.

14. The device of claim 13, further comprising an ear pad that partially defines the front volume, the ear pad operative to be arranged in contact with a head of a wearer to substantially seal the front volume.

15. The device of claim 13, wherein the back volume is sealed.

16. The device of claim 13, wherein the controlled leakage path is partially defined by a hollow tube.

17. The device of claim 16, wherein the hollow tube has a length greater than a width of the hollow tube.

18. The device of claim 13, further comprising a resistive acoustical member arranged in the front volume.

19. The device of claim 18, wherein the resistive acoustical member includes a woven material.

20. The device of claim 18, wherein the resistive acoustical member includes a mesh.

* * * * *